US007251894B2

(12) United States Patent
Zuidervaart et al.

(10) Patent No.: US 7,251,894 B2
(45) Date of Patent: Aug. 7, 2007

(54) DEVICE FOR SHAVING HAIR HAVING A CUTTING MEMBER WITH A PERIODICAL MOTION

(75) Inventors: Jasper Zuidervaart, Drachten (NL); Fokke Roelof Voorhorst, Drachten (NL); Roelof Steunenberg, Drachten (NL); Peter Hans Van Der Vlis, Drachten (NL); Robert Alexander Van Eibergen Santhagens, Drachten (NL); Dirk Hendrik Wevers, Drachten (NL); Willem Auke Westerhof, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/525,286

(22) PCT Filed: Jul. 14, 2003

(86) PCT No.: PCT/IB03/03218

§ 371 (c)(1),
(2), (4) Date: Feb. 16, 2005

(87) PCT Pub. No.: WO2004/018165

PCT Pub. Date: Mar. 4, 2004

(65) Prior Publication Data

US 2005/0252005 A1 Nov. 17, 2005

(30) Foreign Application Priority Data

Aug. 21, 2002 (EP) ..... 02078458

(51) Int. Cl.
*B26B 19/28* (2006.01)
*B26B 19/12* (2006.01)

(52) U.S. Cl. ..... 30/45; 30/34.2; 30/44

(58) Field of Classification Search ..... 30/34.2, 30/44, 45, 42, 46
See application file for complete search history.

(56) References Cited

U.S. PATENT DOCUMENTS

| | | | | | |
|---|---|---|---|---|---|
| 1,788,547 | A | * | 1/1931 | Shaler | 30/45 |
| 2,054,418 | A | | 9/1936 | Hartmann | |
| 3,636,627 | A | * | 1/1972 | Tiffin | 30/45 |
| 3,756,105 | A | * | 9/1973 | Balamuth et al. | 83/14 |
| 3,793,723 | A | * | 2/1974 | Kuris et al. | 30/45 |
| 4,744,144 | A | * | 5/1988 | Lowery et al. | 30/45 |
| 5,007,169 | A | * | 4/1991 | Motta | 30/45 |
| 5,046,249 | A | * | 9/1991 | Kawara et al. | 30/45 |
| 5,056,222 | A | * | 10/1991 | Miller et al. | 30/77 |
| 5,299,354 | A | * | 4/1994 | Metcalf et al. | 30/45 |
| 5,794,342 | A | * | 8/1998 | Davey | 30/45 |
| RE36,816 | E | * | 8/2000 | Apprille et al. | 30/77 |
| 6,421,918 | B1 | * | 7/2002 | Dato et al. | 30/45 |

* cited by examiner

*Primary Examiner*—Boyer D. Ashley
*Assistant Examiner*—Edward Landrum
(74) *Attorney, Agent, or Firm*—Adam L. Stroud

(57) ABSTRACT

The invention relates to a device (1) for shaving hair (93) and to a device having a shaving head (9). The shaving head (9) has at least one cutting member (17, 19) having a cutting edge (23) and a cutting direction (X), and the device has an actuator (29) for effecting a periodical motion of the cutting member relative to a base portion (3) of the device. According to the invention the periodical motion is effected in an imaginary plane which extends transversely to the cutting edge (23) and which has a first motion portion (89) and a second motion portion (91) following the first motion portion. The first motion portion is mainly directed in the cutting direction (X), and the second motion portion is mainly directed opposite to the cutting direction and is closer to the skin (93) than the first motion portion.

5 Claims, 5 Drawing Sheets

DEVICE FOR SHAVING HAIR HAVING A CUTTING MEMBER WITH A PERIODICAL MOTION

Figure 1:
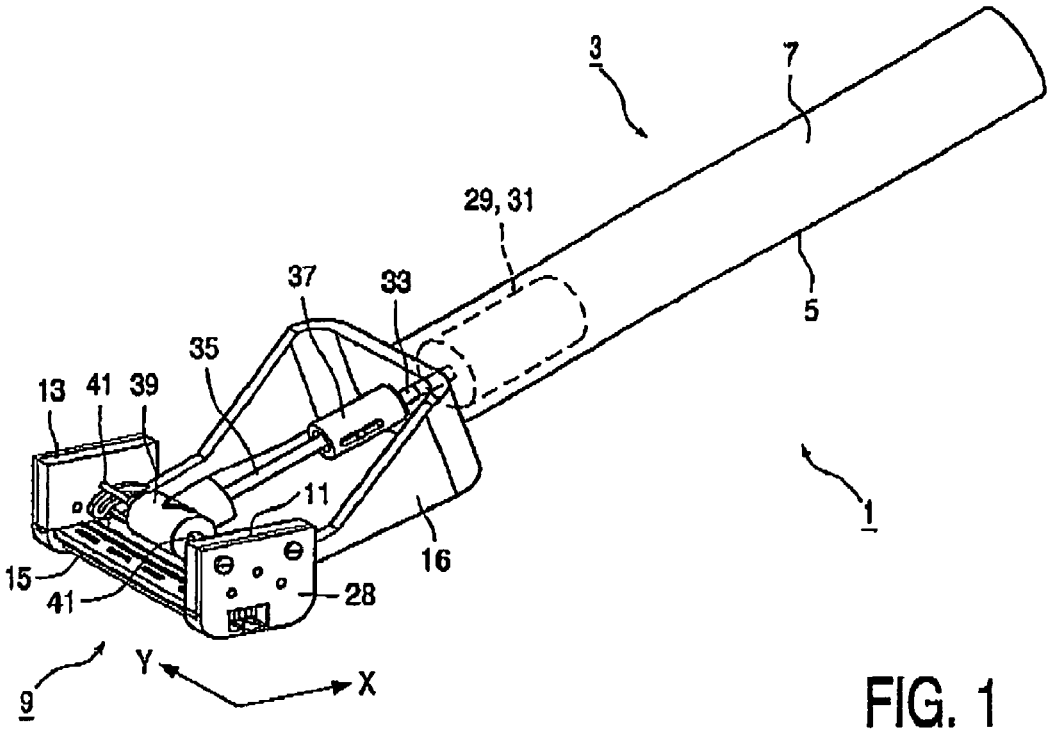

The invention relates to a device for shaving hair, comprising a base portion having a grip, at least one cutting member having a cutting edge and a cutting direction, and an actuator for effecting a periodical motion of the cutting member relative to the base portion.

The invention further relates to a shaving head suitable for use in a device for shaving hair, said shaving head comprising at least one cutting member having a cutting edge and a cutting direction, and a coupling member by means of which the shaving head can be coupled to a base portion of said device, said base portion comprising an actuator for effecting a periodical motion of the cutting member relative to the base portion.

A device for shaving hair of the kind mentioned in the opening paragraphs and comprising a shaving head of the kind mentioned in the opening paragraphs is known from U.S. Pat. No. 2,054,418. The shaving head of the known device comprises a blade-shaped cutting member. The actuator of the known device comprises an electric motor having a shaft to which a flywheel is eccentrically secured. The flywheel is arranged in the shaving head of the known device and is substantially parallel to the main surfaces of the cutting member. The shaft is supported by two bearings, one of which is also arranged in the shaving head. During operation, when the flywheel is rotated by the motor, the flywheel exerts periodical forces on the bearings. Via the bearing arranged in the shaving head, said forces are transmitted to the shaving head and effect a circular periodical motion of the shaving head and of the cutting member mounted therein relative to the base portion. The circular periodical motion of the cutting member takes place substantially in an imaginary plane parallel to the main surfaces of the cutting member. As a result of said periodical motion of the cutting member, the device has an improved hair cutting action.

A disadvantage of the known device for shaving hair and of the known shaving head used therein is that, when the shaving head is moved over the skin in the cutting direction, the skin will bulge in front of the cutting edge as a result of the pressure, which is exerted on the skin by the cutting edge and which depends on the pressure with which the user presses the shaving head on the skin. As a result, there is a considerable risk of skin irritations and skin injuries.

It is an object of the present invention to provide a device for shaving hair and a shaving head of the kinds mentioned in the opening paragraphs by means of which a good hair cutting action and a smooth shaving result are achieved, but wherein the risk of skin irritations and skin injuries is considerably reduced.

In order to achieve this object, a device for shaving hair in accordance with the invention and a shaving head in accordance with the invention are characterized in that the periodical motion is effected substantially in an imaginary plane extending transversely to the cutting edge and has a first motion portion and a second motion portion following the first motion portion, the first motion portion being mainly directed in the cutting direction, and the second motion portion being mainly directed opposite to the cutting direction and being closer to the skin, during operation, than the first motion portion. When the device for shaving hair in accordance with the invention, provided with the shaving head in accordance with the invention, is moved over the skin in the cutting direction of the cutting member, hairs are mainly cut during the first motion portions of the periodical motion of the cutting member. During the second motion portions, the velocity of the cutting member relative to the skin is relatively low and the cutting member even moves in a direction opposite to the cutting direction of the cutting member, so that the cutting member does not cut hairs and also can not cause skin injuries. Since the second motion portions are closer to the skin than the first motion portions, the skin will bulge near the cutting edge mainly during the second motion portions when the cutting member cannot cause skin injuries. During the first motion portions, bulging of the skin near the cutting edge will be considerably reduced or will even be absent or substantially absent, so that during the first motion portions, when the hairs are cut, the risk of skin irritations or injuries is relatively small. During the first motion portions contact between the skin and the cutting edge is maintained as a result of the elasticity of the skin. However, the pressure exerted by the cutting edge on the skin will be relatively small during the first motion portions. In this manner it is achieved that during the first motion portions a smooth shaving result is achieved as a result of said continued contact between the cutting edge and the skin, but the risk of skin irritations and skin injuries is considerably reduced as a result of the relatively small degree of skin bulging near the cutting edge and the relatively small pressure exerted by the cutting edge on the skin.

An additional advantage of the invention is that, during the first motion portions, the cutting member has a cutting speed relative to the skin which is considerably higher than the speed at which the shaving head is moved over the skin. This is a result of the fact that, during the first motion portions, the cutting member moves mainly in the cutting direction relative to the base portion. As a result, the time necessary to cut a hair is considerably reduced, so that the time during which a pulling force is exerted on the hair during cutting is relatively short. As a result, the user experiences a relatively high level of shaving comfort.

A further advantage of the invention is that, when the cutting member moves in a direction opposite to the cutting direction during the second motion portions, the friction forces exerted by the skin on the cutting member are directed in the cutting direction and thus provide a traction force on the shaving head in the direction in which the shaving head is moved over the skin. During the first motion portions, said friction forces are relatively small as a result of the relatively small pressure between the cutting member and the skin. The overall effect is that the shaving head can be easily moved over the skin and accordingly has good gliding properties with respect to the skin.

A yet further advantage of the invention is that the periodical motion of the cutting member results in a stimulation of the nerves in the skin. This effect is enhanced because the periodical motion of the cutting member has a component perpendicular to the skin as a result of the fact that the second motion portion is closer to the skin than the first motion portion. As a result of said stimulation of the nerves pain sensations, which occur as a result of pulling forces exerted on the hairs during cutting, will be perceived by the user to a considerably lesser extent.

A particular embodiment of a device for shaving hair in accordance with the invention is characterized in that the periodical motion has a frequency between approximately 100 Hz and approximately 1000 Hz. It was found that, when the frequency of the periodical motion is within said range, the effects and advantages of the invention as described before manifest themselves to a high extent.

A further embodiment of a device for shaving hair in accordance with the invention is characterized in that the periodical motion has a frequency of approximately 200 Hz. It was found that, when the frequency of the periodical motion is approximately 200 Hz, most effects and advantages of the invention as described before manifest themselves to an optimum extent.

A particular embodiment of a device for shaving hair in accordance with the invention is characterized in that the periodical motion is a substantially elliptical motion having a major axis and a minor axis, the major axis being mainly directed parallel to the cutting direction. It was found that the effects and advantages of the invention as described before particularly manifest themselves when the first and the second motion portion have a length which is considerably larger than a distance which is present between the first and the second motion portion in a direction perpendicular to the skin. By means of said elliptical motion, such a relation between said length and said distance is achieved in a practical manner, the first motion portion taking place in an upper part of the elliptical motion, and the second motion portion taking place in a lower part of the elliptical motion, as seen with respect to the skin. Such an elliptical motion can be achieved by means of a relatively simple, practical and reliable driving mechanism and with relatively small and gradual acceleration forces.

A further embodiment of a device for shaving hair in accordance with the invention is characterized in that the major axis has a length between approximately 0.1 mm and 0.6 mm and the minor axis has a length between approximately 0.02 mm and 0.15 mm. It was found that, when the major axis and the minor axis of the elliptical motion have a length within said ranges, the effects and advantages of the invention as described before manifest themselves to a high extent.

A yet further embodiment of a device for shaving hair in accordance with the invention is characterized in that the major axis has a length of approximately 0.4 mm and the minor axis has a length of approximately 0.05 mm. It was found that, when the major axis of the elliptical motion has a length of approximately 0.4 mm and the minor axis of the elliptical motion has a length of approximately 0.05 mm, most effects and advantages of the invention as described before manifest themselves to an optimum extent.

A further embodiment of a device for shaving hair in accordance with the invention is characterized in that the device has a skin contact member which defines an imaginary skin contact surface along which the device is in contact with the skin during operation, wherein the major axis and the skin contact surface enclose an angle between approximately −30° and approximately +30°. It was found that, when the angle enclosed by the major axis of the elliptical motion and the skin contact surface is within said range, the effects and advantages of the invention as described before manifest themselves to a high extent.

A yet further embodiment of a device for shaving hair in accordance with the invention is characterized in that the major axis extends substantially parallel to the skin contact surface. It was found that, when the major axis of the elliptical motion extends substantially parallel to the skin contact surface, i.e. when the angle enclosed by the major axis and the skin contact surface is approximately 0°, most effects and advantages of the invention as described before manifest themselves to an optimum extent.

A particular embodiment of a device for shaving hair in accordance with the invention is characterized in that the cutting member is arranged in a shaving head which is mounted to the base portion, the actuator effecting a periodical motion of the cutting member relative to the shaving head. In this embodiment the shaving head is stationary relative to the base portion, and the actuator effects a periodical motion of the cutting member relative to the shaving head and the base portion. An advantage of this embodiment is that the position of the skin relative to the periodical motion of the cutting member and, as a result, the positions of the first and the second motion portion relative to the skin are well defined by the stationary shaving head, so that the effects and advantages of the invention manifest themselves to an optimum extent. In addition, the mass of the portion of the device which performs the periodical motion is limited, so that the necessary driving forces and also the reaction forces experienced by the user are limited.

A particular embodiment of a device for shaving hair in accordance with the invention is characterized in that the cutting member is mounted in a shaving head which is mounted to the base portion, the actuator effecting a joint periodical motion of the shaving head and the cutting member relative to the base portion. In this embodiment the cutting member is stationary relative to the shaving head, and the actuator effects a joint periodical motion of the shaving head and the cutting member mounted therein relative to the base portion. An advantage of this embodiment is that the structure of the shaving head and the cutting member mounted therein is relatively simple, because the driving mechanism can be mainly arranged outside the shaving head.

A particular embodiment of a device for shaving hair in accordance with the invention is characterized in that the device is provided with at least a first cutting member and a second cutting member, wherein the actuator effects a first periodical motion of the first cutting member and a second periodical motion of the second cutting member, and wherein at least one of the two motion portions of the first periodical motion and of the second periodical motion have different parameters. In such an embodiment with two or more separate cutting members arranged in a single shaving head, the contribution of each individual cutting member to the overall shaving performance of the shaving head is specific and different from the contribution(s) of the other cutting member(s). Since in this embodiment the periodical motions of the cutting members have mutually different parameters, the parameters of the periodical motion of each individual cutting member can be optimized in such a manner that each individual cutting member has an optimum contribution to the overall shaving performance of the shaving head. In this manner the overall shaving performance of the shaving head is further improved.

A further embodiment of a device for shaving hair in accordance with the invention is characterized in that the cutting member is mounted to a carrier which is driven by the actuator via a transmission comprising a first and a second eccentric member which are driven by the actuator at equal rotational speeds about separate axes of rotation extending parallel to the cutting edge, said first eccentric member having a fixed position relative to the carrier in a direction parallel to the major axis and a free position relative to the carrier in a direction parallel to the minor axis, and said second eccentric member having a free position relative to the carrier in a direction parallel to the major axis and a fixed position relative to the carrier in a direction parallel to the minor axis. In this manner, a simple, compact, accurate, and reliable driving mechanism is obtained to effect an elliptical motion of the cutting member relative to the shaving head.

Figure 2:
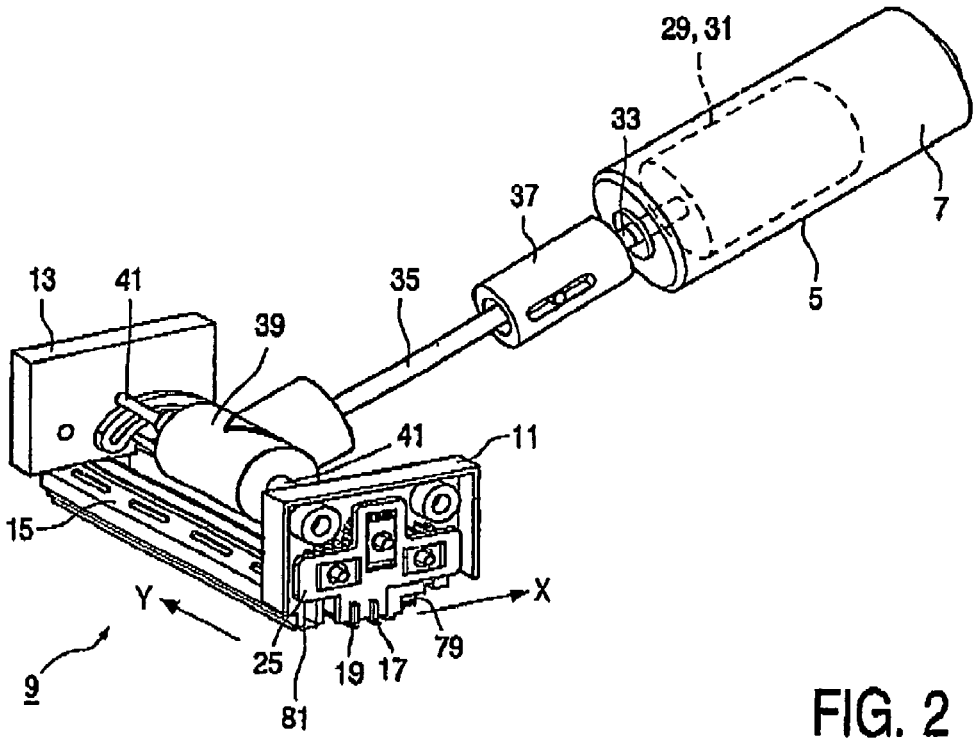
Figure 3:
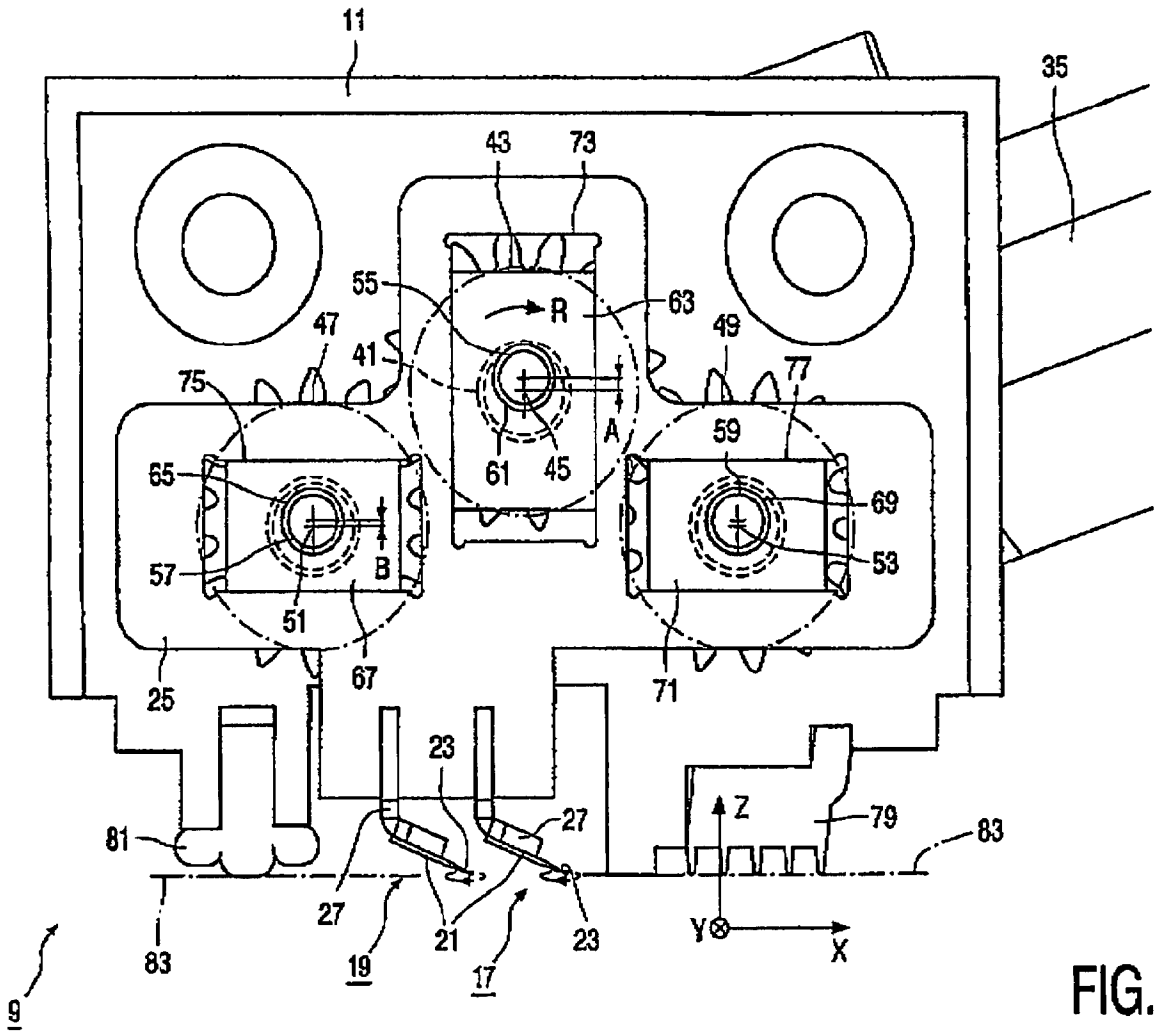
Figure 4:
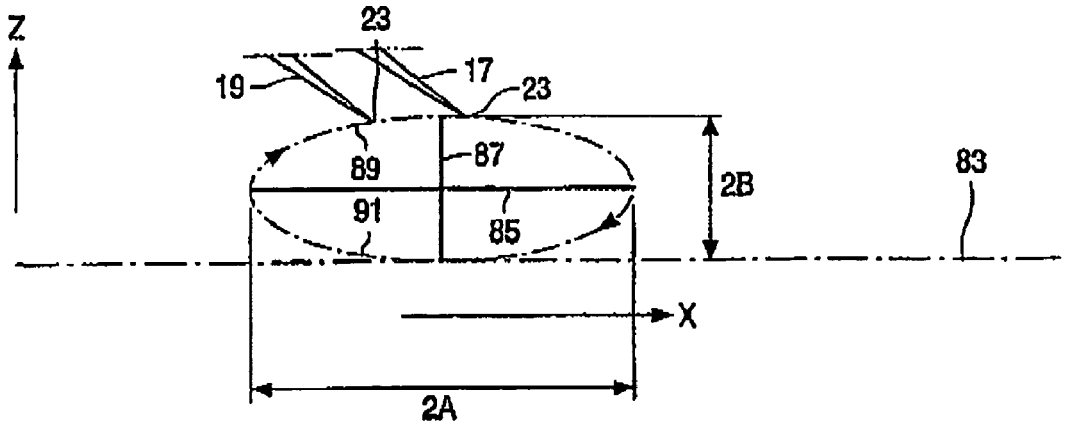
Figure 5A:
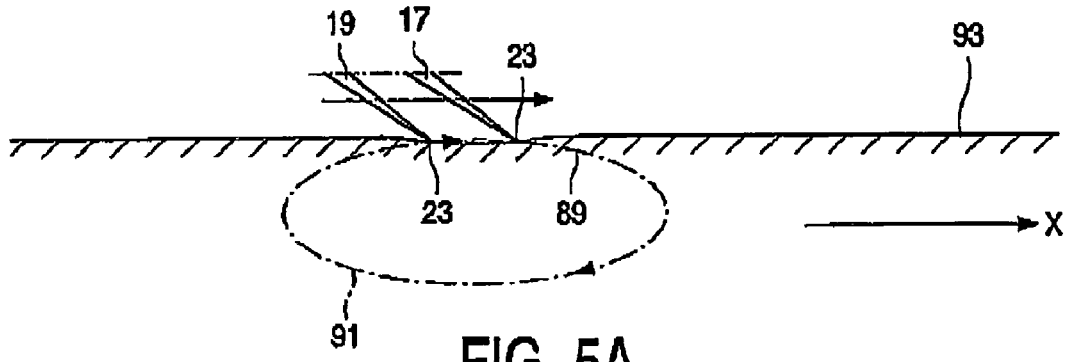
Figure 5B:
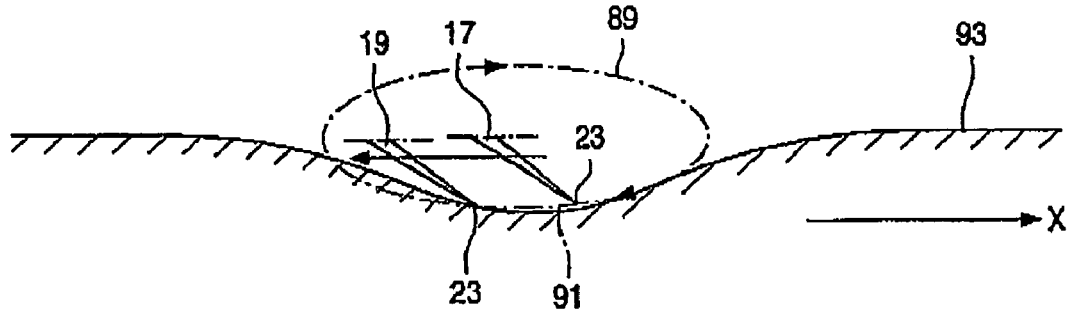

Embodiments of a device for shaving hair in accordance with the invention and of a shaving head in accordance with the invention will be described in the following with reference to the drawings, in which FIG. 1 schematically shows a device for shaving hair according to the invention, which is provided with a shaving head according to the invention, FIG. 2 schematically shows the shaving head of the device of FIG. 1, FIG. 3 is a schematic side view of the shaving head of the device of FIG. 1, FIG. 4 shows in detail a periodical elliptical motion of a cutting member of the shaving head of FIG. 2, FIG. 5A schematically shows a first motion portion of the elliptical motion of FIG. 4, FIG. 5B schematically shows a second motion portion of the elliptical motion of FIG. 4, and FIG. 6A, 6B, 6C show alternative periodical motions of a cutting member of a shaving head in accordance with the invention.

Figure 7:
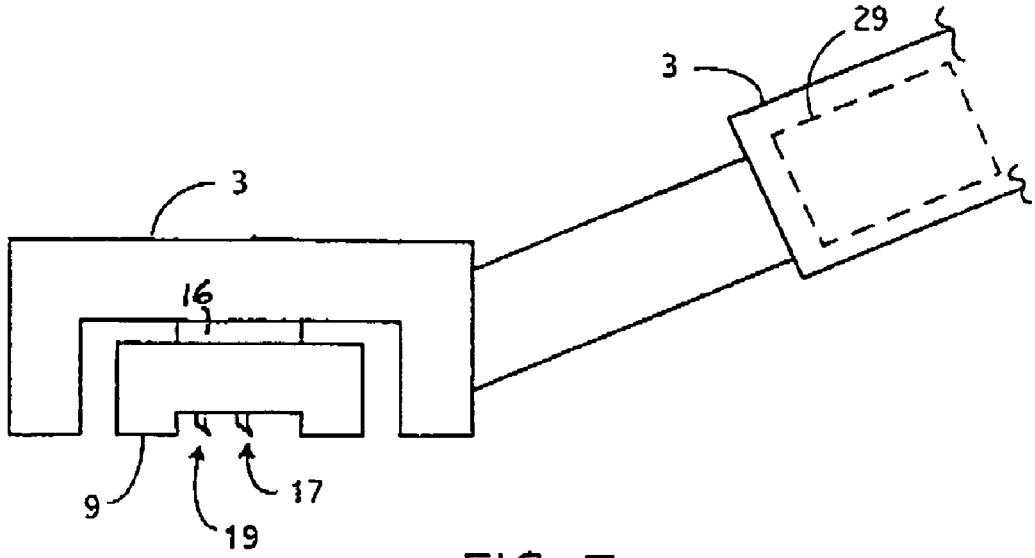

FIG. 7 shows the shaving head and the cutting member having periodical motion. In an embodiment, the periodical is an, elliptical, circular, rectangular, square, or triangular motion. An appropriate driving mechanism capable of producing the desired periodical motion will be appreciated by a person of ordinary skill in the art upon reading the specification.

Figure 8:
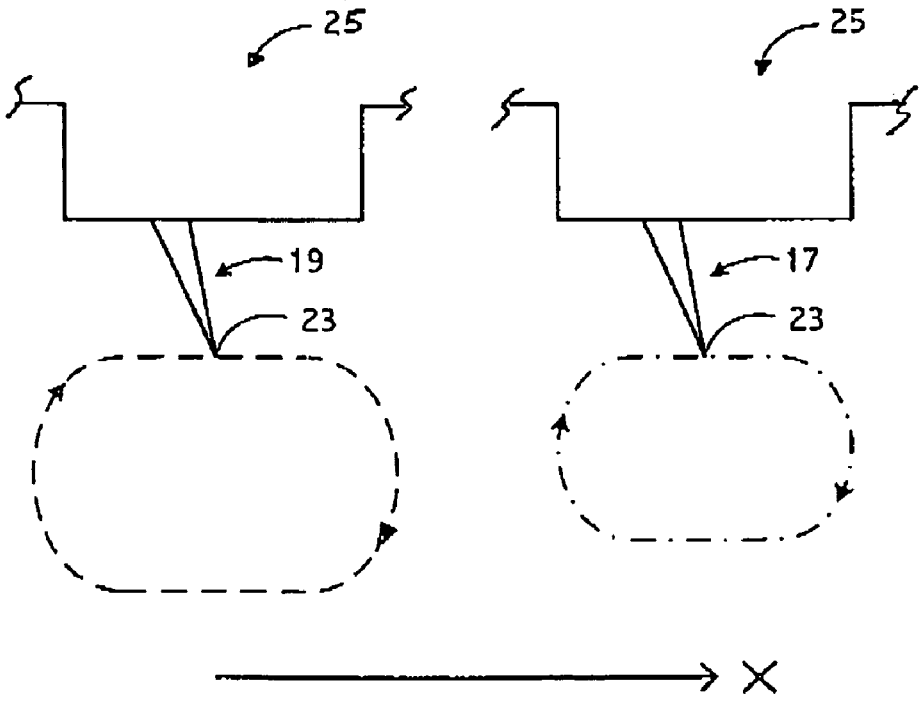

FIG. 8 shows the first and second cutting members being effected by seperate periodical motions.

FIG. 1 schematically shows a device 1 for shaving hair according to the invention. The device 1 comprises a base portion 3, which comprises an elongate hollow cylindrical body 5 in the embodiment shown. The body 5 has a grip 7 by means of which the user can hold the device 1 during operation. The device 1 further comprises a shaving head 9 according to the invention having two side portions 11 and 13 and a bottom portion 15 mutually connecting the side portions 11, 13. The side portions 11, 13 are connected to the body 5 via a coupling member 16. In the embodiment shown, the shaving head 9 can be released from the coupling member 16 and from the body 5 by means of a mechanism not shown in FIG. 1, so that the shaving head 9, when worn out, can be removed from the body 5 and a new shaving head can be coupled to the body 5. It is noted, however, that the invention also covers embodiments wherein the shaving head cannot be released from the base portion.

In the embodiment shown in FIG. 2 the shaving head 9 comprises a first cutting member 17 and a second cutting member 19. As shown in FIG. 3, the cutting members 17, 19 each have a blade-shaped metal carrier 21 on which a straight cutting edge 23 extending substantially parallel to a Y-direction is provided. FIG. 1, FIG. 2 and FIG. 3 further show a cutting direction X of the cutting members 17, 19, i.e. a direction in which the shaving head 9 is to be moved over a skin to be shaved in order to cut hairs present on the skin. Near each of the side portions 11, 13 the cutting members 17, 19 are mounted to a plate-shaped carrier 25 by means of mounting members 27. The carriers 25 are coupled to the side portions 11, 13 in a manner to be described in detail in the following. It is noted that in FIG. 2 and FIG. 3 only the carrier 25, which is present near the side portion 11, is visible because a cover plate 28 of the side portion 11, which is visible in FIG. 1, is not shown in FIG. 2 and FIG. 3. However, a similar carrier is present near the side portion 13. It is further noted that the invention also covers embodiments in which the shaving head of the device comprises a different number of cutting members, for example only one cutting member or three cutting members.

As shown in FIG. 1 and FIG. 2 an actuator 29 is arranged in the hollow cylindrical body 5. In the embodiment shown the actuator 29 comprises an electrical motor 31 having a rotatable output shaft 33. In the embodiment shown the output shaft 33 is releasibly coupled to an input shaft 35 of the shaving head 9 by means of a coupling member 37, so that the output shaft 33 can be uncoupled from the shaving head 9 when the shaving head 9 is released from the base portion 3. The shaving head 9 comprises a gear system 39, which is provided with conical gear wheels not shown in FIG. 1 and FIG. 2 for converting a rotation of the input shaft 35 into a rotation of a main shaft 41 of the shaving head 9, which is rotatably journalled in the side portions 11 and 13 and extends substantially parallel to the cutting edges 23.

As shown in FIG. 3, near each side portion 11, 13 the main shaft 41 carries a first gear wheel 43 which is concentrically mounted to the main shaft 41. Thus the first gear wheel 43 is rotatable about a first axis of rotation 45 coinciding with a central axis of the main shaft 41. Near each side portion 11, 13 a second gear wheel 47 and a third gear wheel 49 are journalled so as to be rotatable about, respectively, a second axis of rotation 51 and a third axis of rotation 53 both extending parallel to the first axis of rotation 45. Near each side portion 11, 13 the second gear wheel 47 and the third gear wheel 49 both engage with the first gear wheel 43. The first, second and third gear wheels 43, 47, 49 have equal diameters and an equal number of teeth, so that the second and third gear wheels 47, 49 are driven by the first gear wheel 43 at a rotational speed equal to the rotational speed of the first gear wheel 43.

The first, second and third gear wheels 43, 47, 49 are each provided with a circularly cylindrical eccentric member 55, 57, 59 on a side facing away from the main shaft 41. The eccentric member 55 is provided on the first gear wheel 43 at a distance A from the first axis of rotation 45, while the eccentric members 57 and 59 are provided on the second and third gear wheels 47, 49 at a distance B from the second and third axes of rotation 51, 53, said distance B being considerably smaller than said distance A. The eccentric member 55 of the first gear wheel 43 is arranged with substantially no play in a circular opening 61 of a first plate-shaped transmission member 63, while the eccentric members 57 and 59 of the second and third gear wheels 47 and 49 are arranged with substantially no play in, respectively, a circular opening 65 of a second plate-shaped transmission member 67 and a circular opening 69 of a third plate-shaped transmission member 71. The first transmission member 63 is provided in a first opening 73 of the carrier 25, the first transmission member 63 having substantially no play relative to said first opening 73 in the cutting direction X and being free to move in said first opening 73 in a Z-direction perpendicular to the cutting direction X and the Y-direction. Likewise, the second and third transmission members 67 and 71 are provided, respectively, in a second opening 75 and in a third opening 77 of the carrier 25. However, the second and third transmission members 67 and 71 are free to move in said second and third openings 75, 77 in the cutting direction X and have substantially no play relative to said second and third openings 75, 77 in the Z-direction. As a result, the eccentric member 55 of the first gear wheel 43 has a fixed position relative to the carrier 25 in the cutting direction X and a free position relative to the carrier 25 in the Z-direction, while the eccentric members 57 and 59 of the second and third gear wheels 47, 49 each have a free position relative to the carrier 25 in the cutting direction X and a fixed position relative to the carrier 25 in the Z-direction.

During operation the eccentric members 55, 57, 59 are driven by the actuator 29 at equal rotational speeds about, respectively, the first axis of rotation 45, the second axis of rotation 51, and the third axis of rotation 53 extending parallel to the cutting edges 23. As a result of the fact that the distance A is considerably larger than the distance B, said rotations of the eccentric members 55, 57, 59 effect a periodical substantially elliptical motion of the carrier 25 and of the cutting members 17, 19 mounted thereto relative to the shaving head 9 and relative to the base portion 3, said elliptical motion having a major axis, which extends in the cutting direction X and has a length equal to 2*A, and a minor axis, which extends in the Z-direction and has a length equal to 2*B. The transmission formed by the input shaft 35, the gear system 39, the main shaft 41, the gear wheels 43, 47, 49, the eccentric members 55, 57, 59, the transmission members 63, 67, 71, and the carriers 25 constitutes a simple, compact, accurate, and reliable driving mechanism for effecting said elliptical motion of the cutting members 17, 19 relative to the shaving head 9 and the base portion 3.

As further shown in FIG. 2 and FIG. 3, the shaving head 9 comprises a skin stretching member 79 made of rubber, which is mounted to the bottom portion 15 of the shaving head 9 in front of the cutting members 17, 19, as seen in the cutting direction X. When the shaving head 9 is moved over the skin in the cutting direction X, the skin stretching member 79 moves over the skin in front of the cutting members 17, 19, so that the skin present before the cutting members 17, 19 is stretched to some extent by the friction force exerted by the skin stretching member 79 on the skin. Behind the cutting members 17, 19, as seen in the cutting direction X, a skin supporting member 81 is mounted to the bottom portion 15 of the shaving head 9. The skin stretching member 79 and the skin-supporting member 81 both extend in directions parallel to the Y-direction and, accordingly, parallel to the cutting edges 23. The skin stretching member 79 and the skin supporting member 81 together form a skin contact member of the shaving head 9, which defines an imaginary skin contact surface 83 extending parallel to the cutting direction X and parallel to the Y-direction, along which skin contact surface 83 the shaving head 9 is in contact with the skin during operation.

Since the major axis of the elliptical motion of the cutting members 17, 19 described before extends in the X-direction and the minor axis of said elliptical motion extends in the Z-direction, i.e. perpendicular to the skin contact surface 83, the periodical elliptical motion of the cutting members 17, 19 is effected in an imaginary plane which extends perpendicularly to the Y-direction, i.e. perpendicularly to the cutting edges 23. The path of the elliptical motion of the cutting members 17, 19 with respect to the skin contact surface 83 and with respect to the cutting direction X is shown in detail in FIG. 4, wherein the major and minor axes are indicated with reference numbers 85 and 87, respectively. As shown in FIG. 3 and FIG. 4, the rotational direction R of the main shaft 41 is such that in a first motion portion 89 of the elliptical motion, i.e. an upper part of the elliptical motion wherein the cutting members 17, 19 are least close to the skin, the cutting members 17, 19 move mainly in the cutting direction X, while in a second motion portion 91 of the elliptical motion, i.e. a lower part of the elliptical motion wherein the cutting members 17, 19 are closest to the skin, the cutting members 17, 19 move mainly in a direction opposite to the cutting direction X. In the embodiment shown the second motion portion 91 is approximately situated in the skin contact surface 83, but this is not a necessity for a proper functioning of the device 1. Accordingly, the elliptical motion may be situated completely above the skin contact surface 83, as seen with respect to the skin, but may also be situated partially or even completely below the skin contact surface 83, depending on the other parameters of the elliptical motion as described in the following. In each case, however, the second motion portion 91, wherein the cutting members 17, 19 move mainly in a direction opposite to the cutting direction X, should be closer to the skin than the first motion portion 89, wherein the cutting members 17, 19 move mainly in the cutting direction X.

The effect of the elliptical motion of the cutting members 17, 19 is as follows. When the shaving head 9 is moved over the skin in the cutting direction X, the user will slightly press the shaving head 9 against the skin. As a result, a pressure is exerted by the cutting edges 23 of the cutting members 17, 19 on the skin, so that the skin will bulge near the cutting edges 23. During the elliptical motion of the cutting members 17, 19 a maximal skin bulging rate and a maximal pressure of the cutting edges 23 will be present during the second motion portions 91 when the cutting members 17, 19 are closest to the skin 93. This situation is schematically shown in FIG. 5B. During the first motion portions 89, as schematically shown in FIG. 5A, the skin bulging rate is considerably smaller, or will even be negligible or zero, depending on the parameters of the elliptical motion as described in the following. When the cutting members 17, 19 move from the second motion portion 91 to the first motion portion 89, the cutting members 17, 19 move away from the skin 93 and the skin 93 will follow the cutting members 17, 19 and maintain in contact with the cutting edges 23 as a result of its elasticity. As a result of the viscous properties of the skin 93, however, the pressure exerted by the skin 93 on the cutting edges 23 will strongly decrease and, as a result, the pressure exerted by the cutting edges 23 on the skin 93 will be relatively small or even zero during the first motion portions 89. Accordingly it was found that, as a result of the viscous and elastic properties of the skin 93, the pressure exerted by the user on the shaving head 9 mainly determines the skin bulging rate and the pressure of the cutting edges 23 on the skin 93 during the second motion portions 91, while, during the first motion portions 89, the skin bulging rate and the pressure of the cutting edges 23 on the skin 93 are relatively small and are influenced to a considerably lesser extent by the pressure exerted by the user.

When the shaving head 9 is moved over the skin 93 in the cutting direction X, the velocity of the cutting members 17, 19 relative to the skin 93 is the sum of the velocity at which the user moves the shaving head 9 in the cutting direction X, and the velocity at which the cutting members 17, 19 move relative to the base portion 3 according to the elliptical motion. As a result, the cutting members 17, 19 will have a relatively high velocity in the cutting direction X relative to the skin 93 during the first motion portions 89, and a relatively low velocity in the cutting direction X relative to the skin 93, or even a velocity in the opposite direction, during the second motion portions 91. As a result, hairs present on the skin 93 are mainly cut during the first motion portions 89. During the second motion portions 91 no hairs are cut by the cutting members 17, 19, provided that the frequency and amplitude of the elliptical motion are sufficiently high. Since the skin bulging rate and the pressure exerted by the cutting edges 23 on the skin 93 are relatively small during the first motion portions 89, the risk of skin irritations and skin injuries is relatively small. During the second motion portions 91, the velocity of the cutting members 17, 19 relative to the skin 93 is relatively small and the cutting members may even move in a direction opposite to the cutting direction X, so that the risk of skin irritations and skin injuries is also relatively small or even zero. As a result, the risk of skin irritations and skin injuries as a result of the use of the device 1 in accordance with the invention is relatively small. Since the skin 93 maintains in contact with the cutting edges 23 during the first motion portions 89, the device 1 according to the invention provides a smooth shaving result and a good shaving performance.

The additional advantages of the invention described herein before in the description of the invention will be readily understandable by means of the foregoing detailed description of the device 1. A further advantage of the invention is that, depending on the frequency and the amplitude of the elliptical motion of the cutting members 17, 19 and on the velocity with which the user moves the shaving head 9 over the skin 93, there will be an overlap between the skin portions which are successively shaved during a number of successive first motion portions 89 of the elliptical motion. As a result each skin portion is treated more than once by the cutting members 17, 19 during a single continuous motion of the shaving head 9 over the skin 93, so that the shaving head 9 is very effective.

In the embodiment of the device 1 and the shaving head 9 according to the invention as described before, the periodical elliptical motion of the cutting members 17, 19 has a frequency of approximately 200 Hz. The distance A is approximately 0.2 mm and the distance B is approximately 0.025 mm, so that the major axis 85 of the elliptical motion has a length of approximately 0.4 mm and the minor axis 87 of the elliptical motion has a length of approximately 0.05 mm. Furthermore, the major axis 85 of the elliptical motion extends substantially parallel to the skin contact surface 83. It was found that, with the above-mentioned values for the parameters of the elliptical motion of the cutting members 17, 19, the effects and advantages of the invention manifest themselves to an optimum extent. However, the invention is not limited to embodiments wherein the parameters of the elliptical motion of the cutting members 17, 19 have the above-mentioned values. It was found that most effects and advantages of the invention manifest themselves to a high extent if the frequency of the elliptical motion is between approximately 100 Hz and approximately 1000 Hz, if the major axis 85 of the elliptical motion has a length between approximately 0.1 mm and 0.6 mm, if the minor axis 87 of the elliptical motion has a length between approximately 0.02 mm and 0.15 mm, and if the major axis 85 of the elliptical motion and the skin contact surface 83 enclose an angle between approximately −30° and +30°. It is noted that in the foregoing the expression "approximately" intends to indicate a margin of at most 5% of the indicated values. It is however noted that the invention also covers embodiments in which some of the above mentioned parameters of the elliptical motion have values outside the indicated ranges, and the skilled person will be able to find other suitable values for these parameters by means of experiments.

Figure 6A:
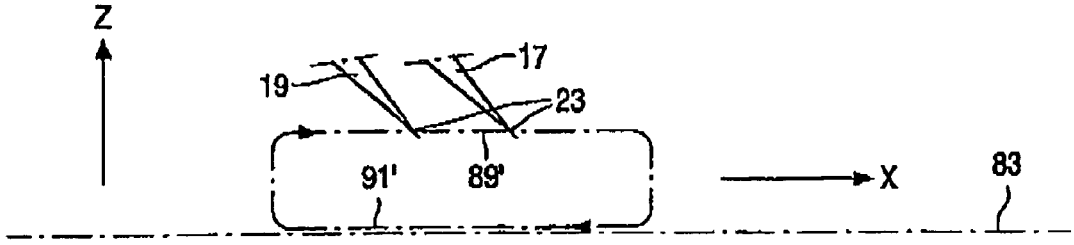
Figure 6B:
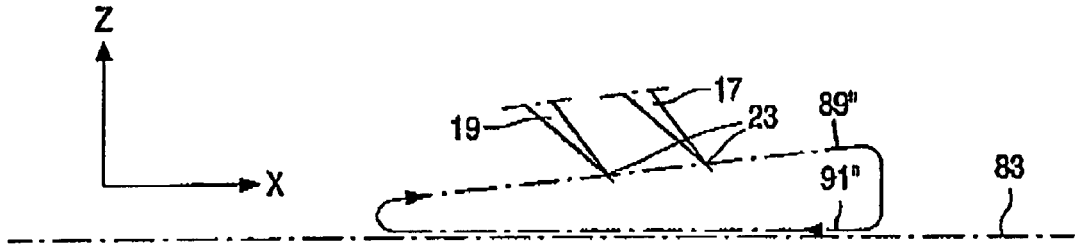
Figure 6C:
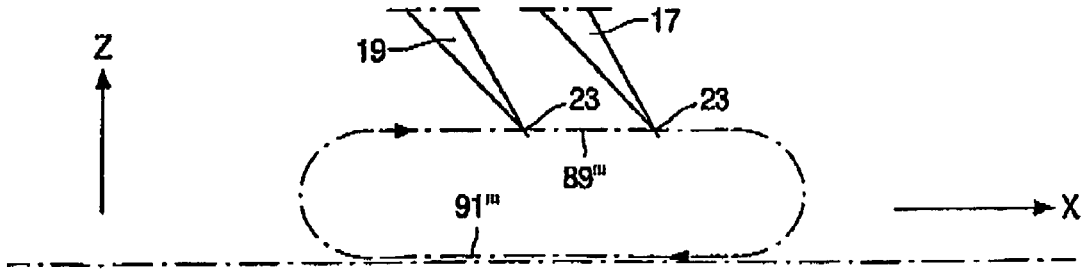

As described in the foregoing, the periodical elliptical motion of the cutting members 17, 19 can be achieved by means of a relatively simple and reliable driving mechanism. The acceleration forces to be exerted on the cutting members 17, 19 are relatively small and gradual, so that the user hardly experiences inconvenient reaction forces of the driving mechanism. However, the invention is not limited to embodiments in which an elliptical or substantially elliptical motion of the cutting members is effected. In general, the above-mentioned effects and advantages of the invention manifest themselves if a periodical motion of the cutting members is effected relative to the base portion in an imaginary plane or mainly in an imaginary plane which extends transversely to the cutting edge, and wherein said motion has a first motion portion mainly directed in the cutting direction of the cutting member and a second motion portion following the first motion portion and mainly directed opposite to the cutting direction, said second motion portion being closer to the skin than said first motion portion. In the foregoing the expression "transversely to" is not limited to "perpendicularly to", but intends to indicate that said imaginary plane has a main direction perpendicular to the cutting edge and may have an additional minor direction component in another direction. In a similar manner, the expression "mainly directed" intends to indicate that the relevant motion portion has a main motion component in or opposite to the cutting direction, but that an additional minor motion component may be present in another direction. It was further found that the effects and advantages of the invention particularly manifest themselves when said first and second motion components have lengths which are considerably larger than a distance which is present between said first and second motion portions in a direction perpendicular to the skin. The above-described general properties of a periodical motion according to the invention are readily achieved by means of an elliptical motion, but the skilled person will be able to find alternative periodical motions which also have such general properties and will be able to find driving mechanisms to effect such alternative periodical motions. An example of such an alternative periodical motion is an approximately rectangular motion in an imaginary plane transverse to the skin with first and second motion portions 89', 91' as shown in FIG. 6A, a substantially triangular motion wherein the first and second motion portions 89", 91" enclose a relatively small angle as shown in FIG. 6B, or an oval motion with first and second motion portions 89''', 91''' as shown in FIG. 6C. It is noted, however, that the effects and advantages of the invention also manifest themselves to some degree when said first and second motion components have lengths which are comparable with the distance which is present between said first and second motion portions in a direction perpendicular to the skin. Accordingly, the invention also covers embodiments in which the periodical motion is, for example, a circular motion, in which case a relatively simple driving mechanism can be used, or approximates a square motion.

In the device 1 and in the shaving head 9 as described before, the shaving head 9 is stationary relative to the base portion 3, and the actuator 29 effects a periodical motion of the cutting members 17, 19 relative to the shaving head 9 and the base portion 3. An advantage is that the position of the skin 93 relative to the periodical motion of the cutting members 17, 19 and, in particular, the positions of the first and second motion portions 89, 91 of the elliptical motion relative to the skin are well defined by the stationary skin contact surface 83, so that the effects and advantages of the invention can manifest themselves to an optimum extent. In addition, the total mass of the periodically moving portions of the shaving head 9 is considerably limited, so that the necessary driving forces and the reaction forces experienced by the user holding the device 1 are considerably limited. However, the invention also covers embodiments in which the necessary periodical motion of the cutting member relative to the base portion of the device is achieved in that the actuator effects a periodical motion of the entire shaving head including the cutting member mounted therein. In such an embodiment the cutting member is mounted in a stationary or substantially stationary position in the shaving head, so that the structure of the shaving head and the cutting member mounted therein is relatively simple. Such an alternative embodiment may be advantageous in embodiments of the device according to the invention wherein the shaving head can be uncoupled from the base portion and exchanged for a new shaving head. In such an embodiment the driving mechanism, which effects the periodical motion of the entire shaving head, can be mainly arranged outside the shaving head, so that the costs of the exchangeable portion of the device are limited. Such an alternative embodiment is illustrated in FIG. 7, showing a coupling member 16 disposed so as to enable uncoupling of the shaving head 9 (and its cutting member) from the base portion 3. It Is understood that the skilled person will be able to find a suitable structure and a suitable driving mechanism for such an alternative embodiment.

In the device 1 and in the shaving head 9 as described before the cutting members 17, 19 are jointly mounted to the carriers 25, so that the cutting members 17, 19 are subjected to identical periodical motions. The invention also covers embodiments of a device far shaving hair and of a shaving head for use therein, wherein the shaving head has two or more cutting members, wherein a first one of said cutting members is subjected to a first periodical motion and a second one of said cutting members is subjected to a second periodical motion, and wherein at least one of the motion portions of said first and second periodical motions have mutually different parameters. Such an alternative embodiment of a device and a shaving head according to the invention is illustrated in FIG. 8. There, a suitable driving mechanism may for example be obtained by providing further carrier 25 adjacent to the carrier 25, and by mounting one of the cutting members 17, 19 to said further carrier 25 instead of to the carrier 25. The further carrier 25 may be driven by three additional eccentric members, which are coupled to the gear wheels 43, 47, 49 as axial extensions of the eccentric members 55, 57, 59, but which have radial and tangential positions relative to the gear wheels 43, 47, 49 which differ from the radial and tangential positions of the eccentric members 55, 57, 59 relative to the gear wheels 43, 47, 49. Since in such an alternative embodiment the periodical motions of the cutting members have mutually different parameters, the parameters of the periodical motion of each individual cutting member can be optimized in such a manner that each individual cutting member has an optimum contribution to the overall shaving performance of the shaving head. In this way the overall performance of the shaving head is further improved.

The invention claimed is:

1. A device for shaving hair, comprising a base portion having a grip, at least one cutting member having a cutting edge and a cutting direction, and an actuator for effecting a periodical motion of the cutting member relative to the base portion, characterized in that the periodical motion is affected substantially in an imaginary plane extending transversely to the cutting edge and has a first motion portion and a second motion portion following the first motion portion, the first motion portion being mainly directed in the cutting direction, and the second motion portion being mainly directed opposite to the cutting direction and being closer to the skin, during operation, than the first motion portion, the periodical motion is a substantially elliptical motion having a major axis and a minor axis, the major axis being mainly directed parallel to the cutting direction, and that the cutting member is mounted to a carrier which is driven by the actuator via a transmission comprising a first and a second eccentric member which are driven by the actuator at equal rotational speeds about separate axes of rotation extending parallel to the cutting edge, said first eccentric member having a fixed position relative to the carrier in a direction parallel to the major axis and a free position relative to the carrier in a direction parallel to the minor axis, and said second eccentric member having a free position relative to the carrier in a direction parallel to the major axis and a fixed position relative to the carrier in a direction parallel to the minor axis.

2. A shaving head as claimed in claim 1, wherein the periodical motion is substantially elliptical, rectangular, triangular, circular, oval-shaped or square-shaped.

3. A device as claimed in claim 1, characterized in that the periodical motion has a frequency between approximately 100 Hz and approximately 1000 Hz.

4. A device as claimed in claim 1, characterized in that the periodical motion has a frequency of approximately 200 Hz.

5. A device as claimed in claim 1, characterized in that the major axis has a length between approximately 0.1 mm and 0.6 mm and the minor axis has a length between approximately 0.02 mm and 0.15 mm.

* * * * *